US007045027B2

(12) United States Patent
Okuzawa et al.

(10) Patent No.: US 7,045,027 B2
(45) Date of Patent: May 16, 2006

(54) METHOD OF PRODUCING A FIBER BOARD

(75) Inventors: Masayuki Okuzawa, Sanda (JP); Kenji Ohnishi, Osaka (JP); Yuzo Okudaira, Hyogo (JP); Hideyuki Ando, Suita (JP); Kazunori Umeoka, Nara (JP); Bunkai Ryu, Kadoma (JP); Shigeki Naito, Shijonawate (JP); Ryo Sugawara, Nishinomiya (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/757,532

(22) Filed: Jan. 15, 2004

(65) Prior Publication Data

US 2004/0187998 A1 Sep. 30, 2004

(30) Foreign Application Priority Data

Mar. 31, 2003 (JP) ..... 2003-096846

(51) Int. Cl.
*D21J 1/00* (2006.01)

(52) U.S. Cl. ..... 156/62.4; 156/325; 162/98; 162/10; 162/11; 162/12; 19/1; 19/288

(58) Field of Classification Search ..... 156/62.4
See application file for complete search history.

(56) References Cited

U.S. PATENT DOCUMENTS 4,533,436 A * 8/1985 Betzner et al. ..... 162/261
5,100,511 A * 3/1992 Simonson et al. ..... 162/11
5,492,756 A 2/1996 Seale et al.
5,507,074 A 4/1996 Chen et al.
5,728,269 A 3/1998 Kohno et al.
5,970,582 A 10/1999 Stover
6,197,414 B1 * 3/2001 Kawai et al. ..... 428/297.4

FOREIGN PATENT DOCUMENTS

GB 2013747 A * 8/1979
JP 6-285819 A 10/1994
JP 2000-263519 A 9/2000
JP 2002-248610 A 9/2002
JP 2002-283313 A 10/2002
JP 2003-39411 A 2/2003

* cited by examiner

*Primary Examiner*—Jeff H. Aftergut
*Assistant Examiner*—Chris Schatz
(74) *Attorney, Agent, or Firm*—Birch Stewart Kolasch & Birch LLP

(57) ABSTRACT

The present invention relates to a method of producing a fiber board characterized in that it comprises the following processes (a)–(f):
(a) a separating process of a bast portion,
(b) a fiberizing process by defibrating the bast portion of the kenaf,
(c) a preparing process of a mat comprising the kenaf fibers having an average length of 10–200 mm and an average diameter of 10–300 μm,
(d) a supplying process of an adhesive agent into the fiber mat,
(e) a drying process of the adhesive agent, and
(f) a molding process by heating said fiber mat under pressure to form a fiber board having a density of 600–900 kg/m$^3$.

9 Claims, 8 Drawing Sheets

METHOD OF PRODUCING A FIBER BOARD

This Non-provisional application claims priority under 35 U.S.C. § 119(a) on Patent Application No(s). 2003-096846 filed in Japan on Mar. 31, 2003, the entire contents of which are hereby incorporated by reference.

BACKGROUND OF THE INVENTION

1. Field of the Invention

The present invention relates to a method of producing a fiber board which comprises kenaf fibers as a base material.

2. Description of the Related Art

Conventionally, with respect to a wall material used for forming walls of a house and the like, a fiber board having moisture permeability (air permeability) has been used. In general, since the water vapor pressure inside a room is higher than the water vapor pressure outside the room, when such a moisture permeable fiber board is used for forming walls, moisture (water content) inside a room can be transported outside the room through the walls.

With respect to the moisture permeable fiber board as described above, conventionally, molded boards mainly composed of natural plant fibers, such as oil palm fibers and jute fibers, have been known (see, for example, JP-A No. 6-285819 (paragraph number [0011] and the like). In the case when, with respect to these molded boards, rigidity is desired in addition to air permeability, these properties can be achieved by properly setting the kind and the rate of use of its adhesive agent.

DISCLOSURE OF INVENTION

In the above-mentioned molded board, however, the rigidity and strength, obtained by properly setting the kind and the like of the adhesive agent, are limited. Even when the rigidity and strength are increased beyond this limitation, this arrangement no longer maintains sufficient moisture permeability in most cases, resulting in the following problems.

In other words, when a wall is formed by using a molded board that is insufficient in moisture permeability, this wall of course makes it difficult for moisture in the room to permeate into the wall, and moisture, once permeated into the wall, is hardly released outside the room, and stays in the wall. In such a case, even when the strength of the wall has been increased to a certain level, dew condensation soon occurs inside the wall, with the result that pillars and heat-insulating materials inside the wall tend to become rotten due to the dew condensation, causing a reduction in the strength of the wall itself. In contrast, a molded board having sufficient moisture permeability originally tends to fail to maintain sufficient strength, and is not applicable as the wall material.

As described above, in the case of the molded board mainly composed of natural plant fibers such as oil palm fibers, it is difficult to satisfy both of moisture permeability and strength required for wall materials for forming walls of a house and the like, and it is also difficult to utilize the above-mentioned molded board as construction materials, such as floor materials, ceiling materials and grounding materials, that require moisture permeability and strength in the same manner as the wall materials.

SUMMARY OF THE INVENTION

The present invention has been made to solve the above-mentioned problems, and its objective is to provide a method of producing a fiber board which has sufficiently high strength with high moisture permeability.

The present invention relates to a method of producing a fiber board characterized in that it comprises the following processes (a)–(f):

(a) a separating process of a bast portion,
(b) a fiberizing process by defibrating the bast portion of the kenaf,
(c) a preparing process of a mat comprising the kenaf fibers having an average length of 10–200 mm and an average diameter of 10–300 μm,
(d) a supplying process of an adhesive agent into the fiber mat,
(e) a drying process of the adhesive agent, and
(f) a molding process by heating said fiber mat under pressure to form a fiber board having a density of 600–900 $kg/m^3$.

BRIEF DESCRIPTION OF DRAWINGS

FIG. 2(*b*) is a diagrammatic sectional view of the preparing process of a mat.

FIG. 2(*c*) is a diagrammatic sectional view of the coating process of an adhesive agent respectively.

FIG. 3(*a*) is a diagrammatic sectional view of the adjusting process of add-on.

FIG. 3(*b*) is a diagrammatic sectional view of one embodiment of a fiber mat.

FIG. 4(*b*) is a diagrammatic sectional view of an impregnated state of monomer component of phenolic resin within the kenaf fiber.

FIG. 4(*c*) is a diagrammatic sectional view of an adhered state of polymer component of phenolic resin on the kenaf fiber respectively.

FIG. 6(*b*) is a diagrammatic sectional view of one embodiment of a fiber board for carrying out the present invention.

FIG. 7(*b*) is a diagrammatic sectional view of one embodiment of a fiber board for carrying out the present invention.

FIG. 8(*b*) is a perspective view of fine fiber sheet.

FIG. 8(*c*) is a diagrammatic view of a floor board.

DETAILED DESCRIPTION OF THE INVENTION

Figure 1:
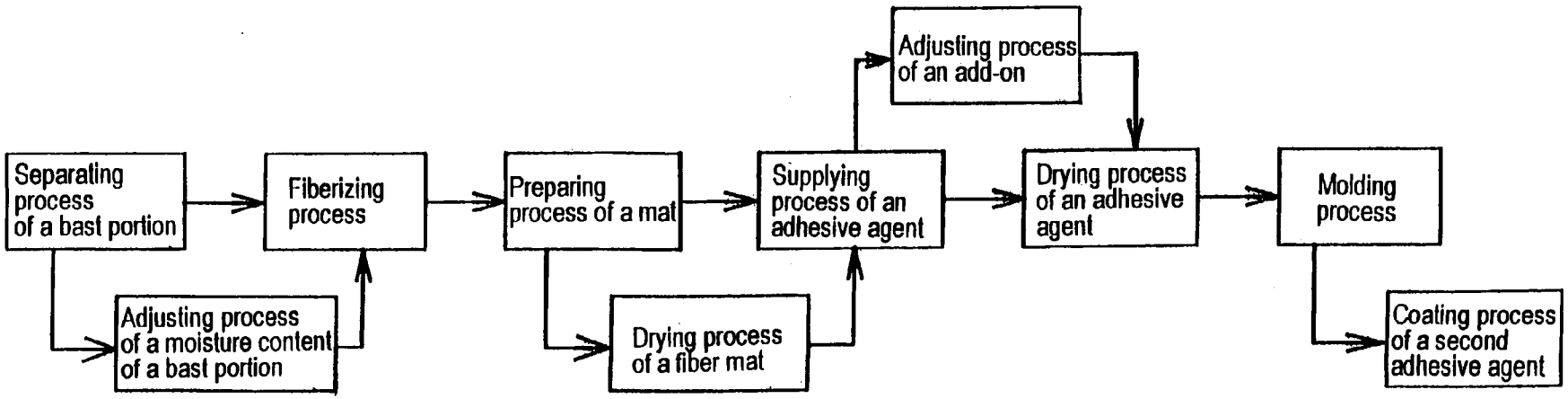
FIG. 1 is a block diagram of the processes constituting one example of a mode for carrying out the present invention.

A first method of producing a fiber board according to the present invention is characterized in that said method comprises the following steps (a)–(f):

(a) a separating process of a bast portion wherein the bast portion of a kenaf is separated from a stem core portion, (b) a fiberizing process wherein kenaf fibers are obtained from the bast portion of the kenaf by defibrating the bast portion of the kenaf, (c) a preparing process of a mat wherein the kenaf fibers obtained by said defibrating treatment are aggregated to form a fiber mat comprising the kenaf fibers having an average length of 10–200 mm and an average diameter of 10–300 μm, (d) a supplying process of an adhesive agent wherein the fiber mat is impregnated with a thermosetting adhesive agent by supplying the thermosetting adhesive agent into the fiber mat, (e) a drying process of the adhesive agent wherein the fiber mat impregnated with the thermosetting adhesive agent is dried, and (f) a molding process wherein the fiber mat obtained in the drying process of the adhesive agent is molded by heating said fiber mat under pressure to form a fiber board having a density of 600–900 kg/m$^3$.

A second invention is characterized in that in the first invention, an adjusting process of an add-on, in which the fiber mat impregnated with the thermosetting adhesive agent is pressed in such a way that an amount of the thermosetting adhesive agent impregnated in the fiber mat is 130% or less relative to a weight of the fiber mat, is added before the drying process of an adhesive agent.

A third invention is characterized in that in the second invention, the method of pressing the fiber mat in the adjusting process of an add-on is a method wherein the fiber mat impregnated with the thermosetting adhesive agent is passed between a pair of rollers.

A fourth invention is characterized in that in any one of the first–third inventions, a drying process of the fiber mat, in which a moisture content of the fiber mat is adjusted to 25 percent by weight or less, is added before the supplying process of an adhesive agent.

A fifth invention is characterized in that in any one of the first–fourth inventions, when the fiber mat impregnated with the thermosetting adhesive agent is dried in the drying process of an adhesive agent, said fiber mat is dried while a surface thereof is contacted with an air stream whose temperature is 120° C. or less.

A sixth invention is characterized in that in any one of the first–fourth inventions, when the fiber mat impregnated with the thermosetting adhesive agent is dried in the drying process of an adhesive agent, said fiber mat is dried in an atmosphere of 120° C. or less while an inner portion of the fiber mat is sucked from one side thereof.

A seventh invention is characterized in that in any one of the first–sixth inventions, an adjusting process of a moisture content in the bast portion, in which a moisture content of the bast portion of kenaf separated from the stem core portion is adjusted to 10–40 percent by weight, is added before the fiberizing process.

A eighth invention is characterized in that in any one of the first–seventh inventions, a coating process of a second adhesive agent, in which the second adhesive agent whose impregnability is lower than that of the thermosetting adhesive agent impregnated in the fiber mat is applied on a surface of the fiber board obtained in the molding process, is added after the molding process.

A ninth invention is characterized in that in any one of the first–eighth inventions, when the fiber mat is heated under pressure in the molding process, a fine fiber sheet formed of fine fibers whose diameter is smaller than that of the kenaf fibers constituting the fiber mat is laminated on the surface of the fiber mat, and then said laminate is heated under pressure.

A tenth invention is characterized in that in the ninth invention, after the laminate of the fiber mat and fine fiber sheet is heated under pressure, holes which penetrate through the fine fiber sheet are arranged on said sheet.

An eleventh invention is characterized in that in any one of the first–tenth invention, the thermosetting adhesive agent is a phenolic resin having an average molecular weight of 400–700, said phenolic resin comprising 10–40 percent by weight of monomer and 60–90 percent by weight of polymer having an average molecular weight of 200–2,000.

Effect of the Invention

The present invention makes it possible to produce a fiber board having sufficiently high strength with high moisture permeability so that the produced fiber board can be utilized as a wall material for forming walls in a house and the like, and also utilized as construction materials, such as floor materials, ceiling materials and grounding materials, that require high moisture permeability and strength in the same manner as the wall materials.

According to the second invention, when the fiber mat is dried in the drying process of an adhesive agent, a migration of the thermosetting adhesive agent within the fiber mat is inhibited to uniformly distribute the thermosetting adhesive agent within the fiber mat, and mechanical properties and water resistance of the fiber board can be increased.

According to the third invention, the add-on of the thermosetting adhesive agent impregnated in the fibber mat can easily be adjusted.

According to the fourth invention, when the thermosetting adhesive agent is supplied in the supplying process of an adhesive agent, an impregnability of a resin component of the adhesive agent into the kenaf fibers whose moisture content is lowered can be increased, and the fiber board having a high dimensional stability can be obtained.

According to the fifth invention, the fiber mat can be dried while the migration of the thermosetting adhesive agent within the fiber mat is inhibited to uniformly distribute the thermosetting adhesive agent within the fiber mat, and mechanical properties and water resistance of the fiber board can be increased.

According to the sixth invention, the fiber mat can be dried in a state wherein a temperature difference in a thickness direction within the fiber mat is small to uniformly distribute the thermosetting adhesive agent within the fiber mat, and mechanical properties and water resistance of the fiber board can be increased.

According to the seventh invention, a low-grade bast portion can also be defibrated by adjusting the moisture content of the bast portion, and it is possible to produce the fiber board by employing the low-grade bast portion.

According to the eighth invention, a facing material can be stuck over the fiber board surface with a high bonding strength, and a smooth surface of the fiber board can be achieved, and it is possible to increase a durability to a caster and the like.

According to the ninth invention, a facing material can be stuck over the fiber board surface with a high bonding strength, and a smooth surface of the fiber board can be achieved, and it is possible to increase a durability to a caster and the like.

According to the tenth invention, when the facing material is stuck over the fine fiber sheet, the adhesive agent can be impregnated to the fiber board through the holes, and a bonding strength of the facing material can be increased.

According to the eleventh invention, the monomer contained at 10 to 40% by weight mainly permeate into the kenaf fibers, while the polymer, contained at 60 to 90% by weight with a molecular weight of 200 to 2,000, is poor in the permeability into the kenaf fibers, and allowed to mainly adhere to the surface of the kenaf fiber. Further, the component that has permeated to the inside of the kenaf fiber is cured so that it becomes possible to suppress moisture absorption into the kenaf fiber, and consequently to suppress swelling and deformation of the kenaf fiber due to moisture absorption; thus, the dimension stability of the fiber board is improved and the component adhering to the surface of the kenaf fiber is cured so that the kenaf fibers are mutually bonded to and combined with one another firmly, and the peel strength in the fiber board is increased. Consequently, it is possible to provide a fiber board having superior dimension stability with high peel strength.

The best mode for carrying out the present invention will be explained below.

Kenaf is an annual plant belonging to Malvaceae. A stem portion of kenaf is constituted of a core portion and a bast portion surrounding said core portion. First of all, in a separating process of the bast portion, the bast portion is separated from the stem portion by grinding the stem portion of kenaf by means of a grinder to obtain the bast portion.

Figure 2A:
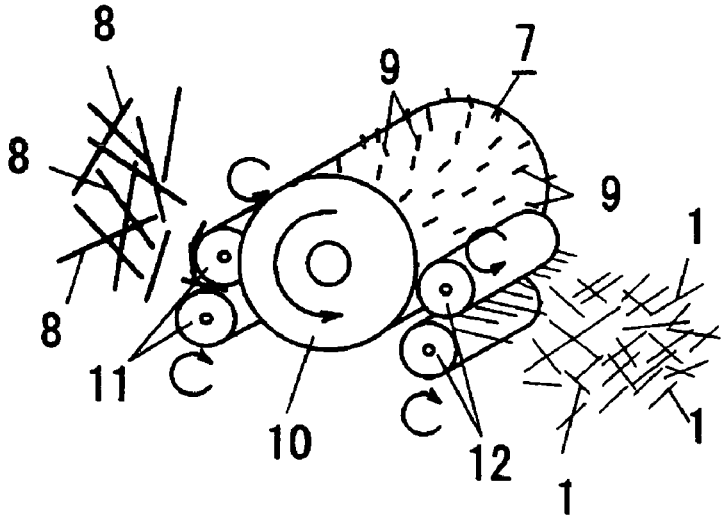
FIG. 2(*a*) is a diagrammatic perspective view of the fiberizing process.
Figure 2B:
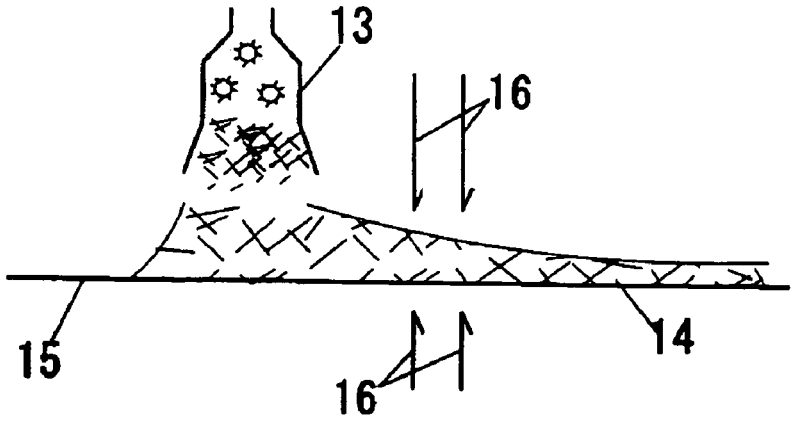
Figure 2C:
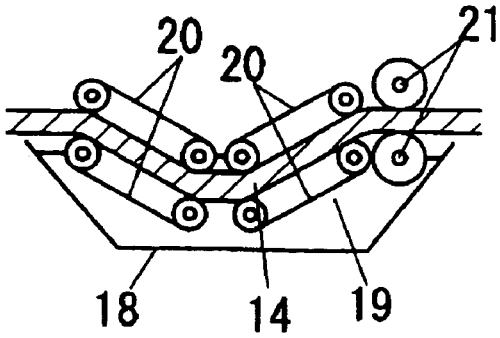

Then kenaf fibers are obtained from the bast portions prepared by the above method in the fiberizing process. FIG. 2(*a*) shows one example of the fiberizing process wherein the kenaf fibers 1 can be obtained by defibrating the bast portions 8 by means of a defibrating apparatus 7. The defibrating apparatus 7 is constituted by a cylinder 10 equipped with many pins 9 having a sharp apex arranged in a protruding state on a peripheral surface of the cylinder 10, and a forward transfer roller 11 and a backward transfer roller 12 that are arranged before and after the cylinder 10 with pins respectively. The bast portions 8 are introduced into the rotating cylinder 10 with pins by means of the forward transfer roller 11 where the bast portions 8 are defibrated by the pins 9 of the cylinder 10 to form the kenaf fibers 1, and said kenaf fibers 1 obtained by defibrating the bast portions are taken out from the rotating cylinder 10 by means of the backward transfer roller 12. In such a case, the kenaf fibers 1 are introduced into or taken out from the rotating cylinder 10 in a state wherein fiber directions are not properly arranged in order to prevent an orientation of the fiber directions of the kenaf fibers 1.

Figure 4A:
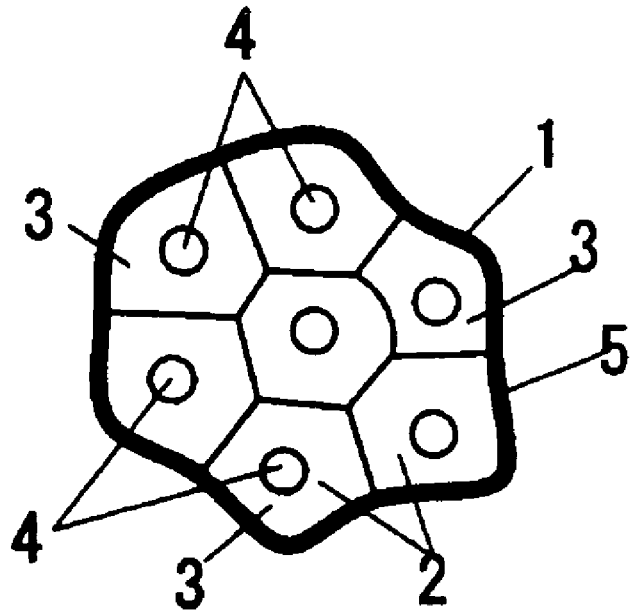
FIG. 4(*a*) is a diagrammatic sectional view of a kenaf fiber.
Figure 4B:
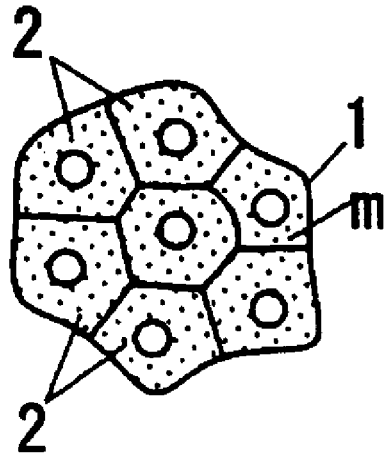
Figure 4C:
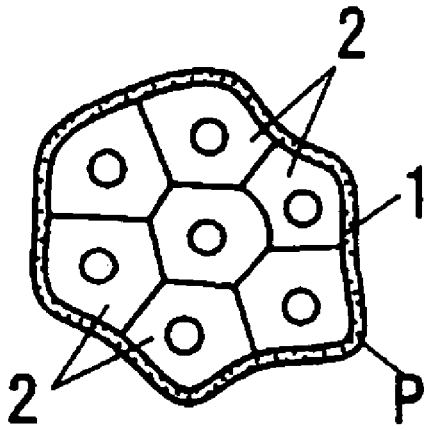

The defibrating treatment in the fiberizing process is carried out in such a way that the kenaf fibers 1 having an average length of 10–200 mm, more preferably 15–80 mm as well as an average diameter of 10–300 μm, more preferably 70–150 μm can be obtained. According to the present invention, the fiber board is produced by employing these defibrated kenaf fibers 1. FIG. 4(*a*) is the diagrammatic view of a section of the kenaf fibers 1 depicted on the basis of a microscopic observation of said section, wherein one kenaf fiber 1 is formed of many single fibers 2 whose diameter is 10–30 μm, said single fibers bonding each other, and the cell walls 3 of the single fibers 2 form the vessels 4 in a center of the single fibers 2. The symbol 5 indicates a surface of the kenaf fiber 1.

When the average length of the kenaf fibers 1 is shorter than the aforementioned range, an interlock of the kenaf fibers 1 becomes insufficient, and a strength of the fiber board cannot sufficiently be increased. In contrast with this, when the average length of the kenaf fibers 1 is longer than the aforementioned range, it is difficult to prepare the aforementioned fiber mat having a uniform structure, and it is apprehended that defective parts in connection with a strength are formed since a variability of density of the fiber board obtained by pressure molding under heat is increased. When the average diameter of the kenaf fibers 1 is smaller than the aforementioned range, although the strength of the fiber board can be increased by an increase of contact points of the kenaf fibers 1 and an intensification of the interlock of the kenaf fibers 1, it is apprehended that a permeability of the fiber board is decreased since the gaps among the kenaf fibers 1 become smaller. In contrast with this, when the average diameter of the kenaf fibers 1 is larger than the aforementioned range, although it is possible to obtain the fiber board having a permeability, the strength of the fiber board is weakened since the average diameter of the kenaf fibers 1 becomes too large as in the case of an oil palm fibers and the like.

Then the fiber mat 14 is obtained in the preparing process of a mat by aggregating the kenaf fibers 1 obtained in the aforementioned fiberizing process. FIG. 2(*b*) shows one example of the fiberizing process wherein the kenaf fibers 1 are distributed on the conveyor net 15 from a nozzle 13 for distributing fibers in order to pile up the kenaf fibers 1 on said conveyor net 15 in a desired thickness to form an aggregate of the kenaf fibers 1, and the fiber mat 14 can be obtained by carrying out a needle-punching of said aggregate wherein needles 16 are thrust into the upper and lower sides of the aggregate on the conveyor net 15 in order to interlock the kenaf fibers 1. In such a case, the fiber mat 14 can be prepared by distributing the kenaf fibers 1 on the conveyor net 15 to pile up the kenaf fibers in a random orientation. Although the fiber directions of the kenaf fibers 1 are randomly orientated as regards only X and Y directions in the above case where the kenaf fibers 1 are merely piled up, the fiber directions can somewhat be randomized in Z direction by compressing the aggregate in length direction (thickness direction and vertical direction) after the kenaf fibers 1 are piled up, and it is possible to increase the properties of the obtained fiber board in connection with the thickness direction.

In the supplying process of an adhesive agent, thermosetting adhesive agent is supplied to the fiber mat obtained by the aforesaid method, and said fiber mat is impregnated with said thermosetting adhesive agent. FIG. 2(*c*) shows one example of the supplying process of an adhesive agent wherein the impregnation bath 18 is supplied with the liquid thermosetting adhesive agent 19, and the fiber mat 14 is impregnated with the thermosetting adhesive agent by passing it through the impregnation bath 18 by means of the transfer conveyor 20 to immerse said fiber mat 14 in the thermosetting adhesive agent 19. The fiber mat 14 impregnated with the thermosetting adhesive agent 19 stored in the impregnation bath 18 is squeezed out through the squeeze rollers 21. Although the thermosetting adhesive agent 19 is not particularly restricted, phenolic resin adhesive, urea resin adhesive, melamine resin adhesive, melamine-urea co-condensation resin adhesive and the like, for example, can be used. It is preferable to adjust a coating build-up of the thermosetting adhesive agent to the fiber mat in such a way that said coating build-up is 5–40 percent by weight, more preferably 15– 30 percent by weight calculated in terms of solid resin component. When the coating build-up is 15 percent by weight or less, particularly 5 percent by weight or less, peel strength of the fiber mat obtained is decreased. In contrast to this, when the coating build-up is 30 percent by weight or more, particularly 40 percent by weight or more, it is apprehended that an impact resistance of the fiber board obtained is decreased.

After the fiber mat 14 is impregnated with the thermosetting adhesive agent as stated above, said fiber mat 14 is dried in the drying process of an adhesive agent in such a way that the prescribed moisture content of the fiber mat 14 can be achieved. The drying process of an adhesive agent can be carried out by sending air with ordinary temperature or hot air to the fiber mat 14, or by introducing the fiber mat 14 into a heating furnace to heat said fiber mat. It is desirable to dry the fiber mat 14 in such a way that the moisture content of the fiber mat is 15 percent by weight or less.

And then the fiber board can be produced by subjecting the fiber mat 14 to the pressure molding under heat in the molding process to cure the thermosetting adhesive agent. Although the conditions of the pressure molding under heat are not particularly restricted, it is preferable to adopt the temperature of 120–190° C. and the pressure of 1–4 MPa, and the molding time may suitably be set depending on the board thickness and heating temperature.

According to the present invention, the fiber board is produced in such way that the density of the fiber board is set to 600–900 kg/m$^3$, more preferably 700–850 kg/m$^3$. The setting of the density of the fiber board can be carried out by an adjustment of contents of the thermosetting adhesive agent when the fiber board is produced, an adjustment of a face weight (weight per unit area) of the fiber mat, or the like. When the density of the fiber board is lower than the aforesaid range, an interlock of the kenaf fibers 1 does not sufficiently contribute to an increase of strength of the fiber board, although a permeability resistance is reduced to increase a permeability by increasing a proportion of the gaps in the fiber boars. It is unsuitable to use such a fiber board as a wall material and the like since it does not have a sufficient strength, although it has a permeability. In contrast to this, when the density of the fiber board is higher than the aforesaid range, the permeability resistance is increased to reduce the permeability, although the interlock of the kenaf fibers 1 sufficiently contributes the increase of the fiber board owing to a decrease of the proportion of the gaps in the fiber board. It is unsuitable to use such a fiber board as a wall material and the like since it has insufficient permeability and is apt to bring about a dew condensation, although it has a sufficient strength. By the way, a board having satisfactory permeability and strength cannot be obtained by using an oil palm fibers since a fiber diameter of the oil palm fibers is thick. In the case where the oil palm fibers and the like are used as a material of floor board, a board which satisfy the surface hardness required for a durability to a caster cannot be obtained since the fiber diameter of these fibers is thick.

As mentioned above, the fiber board according to the present invention has a high permeability as well as a sufficiently high strength since said fiber board is produced by impregnating the fiber mat 14 prepared by aggregating the specified kenaf fibers 1 with the thermosetting adhesive agent in such a way that said fiber board has the density of 600–900 kg/m$^3$. Therefore, the aforesaid fiber board can be utilized not only as a wall material which forms the walls of a house and the like, but also as building materials, such as a floor material, a ceiling material, a substrate material and the like that require the permeability and strength as in the case of the wall material.

In particular, the fiber board having a density in a range of 700 to 850 kg/m$^3$ is allowed to have higher strength as compared with fiber boards having a density that is smaller than 700 kg/m$^3$, and is also allowed to have higher moisture permeability as compared with fiber boards having a density that is greater than 850 kg/m3; thus, it becomes possible to further maintain good balance between the moisture permeability and strength.

In the case where the fiber board is produced by way of the aforementioned processes, although the fiber mat 14 can be dried by heating said fiber mat at the temperature of from ordinary temperature to 120° C., particularly 80–120° C. in the drying process of an adhesive agent, the thermosetting adhesive agent impregnated in the fiber mat 14 migrates from the inside thereof to the surface thereof when said drying process is carried out. As the result, a distribution of the thermosetting adhesive agent in the fiber mat 14 becomes ununiform, and an adhesion/bonding of the kenaf fibers 1 with the thermosetting adhesive agent becomes ununiform, and it is apprehended that the problems concerning mechanical properties and water resistance of the fiber board will be brought about.

In such a case, it is preferable to dry the fiber mat 14 impregnated with the thermosetting adhesive agent while the surface of the fiber mat 14 is contacted with a high speed air flow when said fiber mat is dried under heat. A preferable temperature of the air flow is from an ordinary temperature to 120° C., and a preferable flow velocity of the air flow is 20 m/sec or more. Furthermore it is desirable to bring both sides of the fiber mat 14 into contact with air flow. In this manner, the drying process can be carried out in a short time while the migration of the thermosetting adhesive agent into the fiber mat 14 is inhibited by conducting said drying treatment during the contact of the surface of the fiber mat 14 with the heated air flow. In such a case, the thermosetting adhesive agent can uniformly be distributed in the fiber mat 14, and it is possible to increase the mechanical properties, peel strength and water resistance of the fiber board.

When the fiber mat impregnated with the thermosetting adhesive agent is dried under heat, it is preferable to dry said fiber mat in an atmosphere of from an ordinary temperature to 120° C. while an inside of the fiber mat 14 is sucked from one side of the fiber mat 14. It is preferable to carry out the suction at a flow velocity of about 20 m/sec (wind velocity). By carrying out the drying process while the inside of the fiber mat 14 is sucked from one side thereof, said drying process can be conducted in a short time in a state wherein a temperature difference in a thickness direction within the fiber mat 14 is small. In such a case, the thermosetting adhesive agent can uniformly be distributed within the fiber mat 14, and it is possible to increase the mechanical properties, peel strength and water resistance of the fiber board.

In the case where the fiber board is produced by way of the aforesaid processes, an adjusting process of an add-on may be added between the supplying process of an adhesive agent and drying process of an adhesive agent to adjust the add-on of the thermosetting adhesive agent impregnated in the fiber mat 14. It is preferable to impregnate the fiber mat with the thermosetting adhesive agent after said adhesive agent is diluted with a solvent, such as water or the like 3–6 times. In such a case, it is preferable to adjust the add-on of the thermosetting adhesive agent in such a way that the amount of the thermosetting adhesive agent impregnated in the fiber mat 14 is 130% or less relative to a weight of the fiber mat 14. By carrying out the drying process of an adhesive agent in a state wherein the add-on of the thermosetting adhesive agent impregnated in the fiber mat 14 is adjusted to 130% or less, the drying treatment can be conducted in a short time while the migration of the thermosetting adhesive agent through the gaps of the fiber mat 14 is inhibited. In such a case, the thermosetting adhesive agent can uniformly be distributed within the fiber mat 14, and it is possible to increase the mechanical properties and water resistance of the fiber board. Although the lower limit of the add-on of the thermosetting agent in the fiber mat 14 is not particularly restricted, about 70 percent by weight is the lower limit from a practical viewpoint.

Figure 3A:
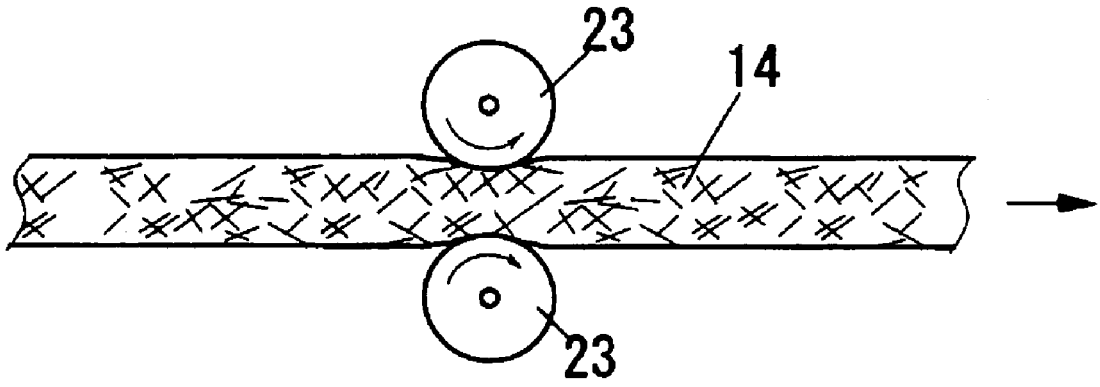
Figure 3B:
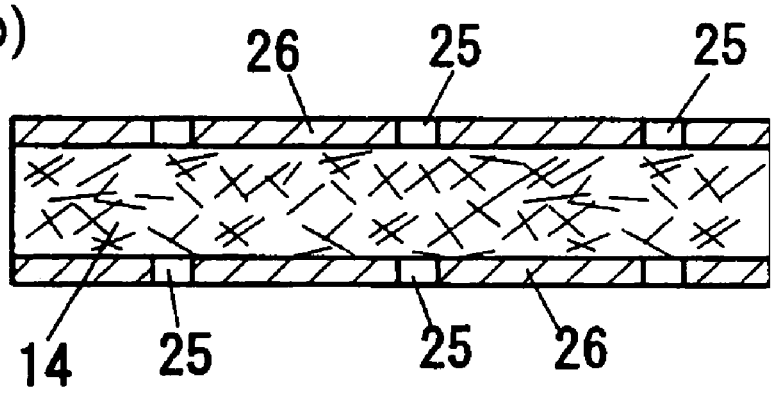

When the add-on of the thermosetting adhesive agent in the fiber mat 14 is adjusted to 130 percent by weight or less in the adjusting process of add-on, the adjustment of the add-on can be carried out by, for example, as shown in FIG. 3(*a*), the fiber mat 14 impregnated with the thermosetting adhesive agent is passed between a pair of rollers 23 under contact pressure of 2.9 MPa (30 kg/cm$^2$)

When the add-on of the thermosetting adhesive agent in the fiber mat 14 is adjusted to 130 percent by weight or less, the fiber mat 14 may be pressed in a state wherein said fiber mat is interposed between two sheet bodies 26 equipped with many holes 25 on their whole area as shown in FIG. 3(*b*), and the fiber mat 14 may be impregnated with the thermosetting adhesive agent in the drying process of an adhesive agent in this pressed state. Perforated metal panel and the like can be used as the sheet bodies 26. By impregnating the fiber mat 14 with the thermosetting adhesive agent in the state wherein said fiber mat is interposed between the sheet bodies 26 equipped with the holes 25 under pressure, the fiber mat 14 can be impregnated with the thermosetting adhesive agent while the add-on of said adhesive agent is adjusted, and said fiber mat can be impregnated with the thermosetting adhesive agent while said add-on is adjusted to 130 percent by weight or less relative to the weight of the fiber mat 14. In such a case, the adjustment of the add-on of the thermosetting adhesive agent in the fiber mat 14 can be carried out without the necessity of the adjusting process of an add-on in particular.

When the fiber board is produced through above each process, a fiber mat-drying process for drying the fiber mat 14 is inserted between the preparation of mat and the supplying process of an adhesive agent so that a moisture content of the fiber mat 14 may be adjusted. It is preferable that the moisture content is adjusted to 25 percent by weight or less, preferably 15 percent by weight or less. The lower limit of the moisture content of the fiber mat 14 is not particularly limited. It is, however, not necessary to lower the moisture content to 5 percent by weight or less. After the fiber mat 14 is dried to moisture content of 25 percent by weight or less, particularly 15 percent by weight or less, the thermosetting adhesive agent is impregnated with in the supplying process of an adhesive agent, so that the resin component penetrate effectively into kenaf fibers 1 to give a fiber board having higher dimensional stability.

According to the present invention, the adjusting process of moisture content of the bast portion may be added between the separating process of the bast portion and fiberizing process, and the moisture content of the bast portion separated from the stem core portion of kenaf in the separating process of the bast portion may be adjusted to 10–40 percent by weight. If the bast portion is a low-grade material containing a part near the root and a skin, the kenaf fibers 1 are damaged to form short fibers when the bast portion is defibrated to form the kenaf fibers 1 in the fiberizing process, and the fiber mat having an excellent quality cannot be obtained. Accordingly, the moisture content of the bast portion is adjusted to 10–40 percent by weight by adding water or hot water to the bast portion in the adjusting process of the moisture content of the bast portion. By adjusting the moisture content of the bast portion to 10–40 percent by weight, the bast portion can smoothly be defibrated without damaging the kenaf fibers 1 even if said bast portion is the low-grade material containing the part near the root and the skin, and kenaf fibers having a prescribed fiber length can be obtained, and it is possible to produce fiber mat having an excellent quality.

Moreover, in the present invention, with respect to the thermosetting adhesive agent to be used for bonding kenaf fibers, various adhesive agents as described above may be used, and among these phenolic resin adhesive agents are preferably used. Among phenolic resins, water-soluble resol-type phenolic resins are preferably used, and the resol-type phenolic resin is prepared in the following manner. In other words, distilled phenol, a formaldehyde aqueous solution and an alkali catalyst are weighed, and loaded into a reaction container, and this is stirred while being heated in an oil bath or the like to undergo a reaction, and to this is added an appropriate amount of sulfuric acid to adjust the pH thereof so that an excessive amount of alkali catalyst is neutralized and precipitated. Then, this is distilled and dehydrated while reducing the pressure by using an aspirator so that a phenolic resin aqueous solution having a weight ratio of non-volatile components (resin components) of approximately 50% is obtained, and this is used as an adhesive agent.

Figure 5:
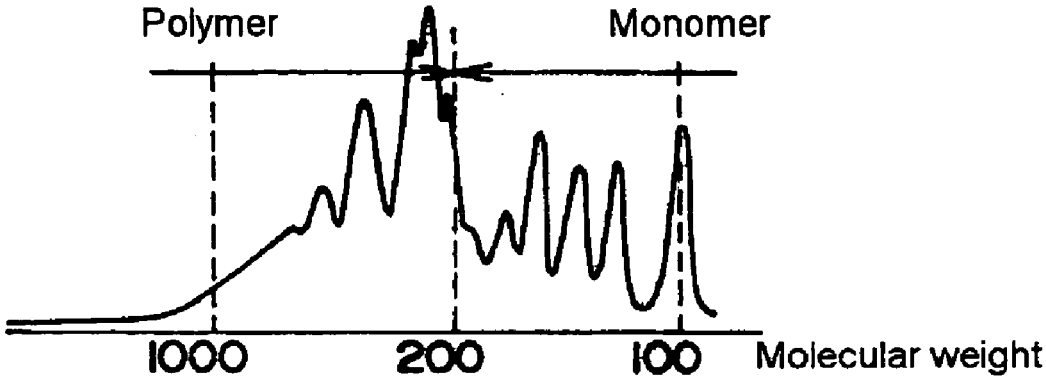
FIG. 5 is a graph showing one example of molecular weight distribution of phenolic resin.

With respect to the alkali catalyst, examples thereof include sodium hydroxide, calcium hydroxide, barium hydroxide, ammonia, amines and the like, and with respect to the reaction conditions, in general, the temperature range is set from 60 to 95° C., and the reaction time is set approximately from several tens of minutes to 2 hours. Here, the resol-type phenolic resin is prepared as a mixture of a monomer, such as phenol, monomethylol phenol, dimethylol phenol and trimethylol phenol, and a polymer in which two or more of these monomers are bonded. In this manner, the phenolic resin contains a monomer having a molecular weight in a range of not less than 90 to less than 200 and a polymer having a molecular weight in a range of not less than 200 to not more than 2,000, and the molecular weight distribution of the phenolic resin is, for example, given in FIG. 5. Upon preparing the above-mentioned phenolic resin, phenolic resins having different molecular weights with different viscosities are obtained by controlling the reaction conditions and molar ratio of phenol and aldehyde as well as by selecting the kind and amount of an alkali catalyst; thus, the molecular weight distribution of the phenolic resin is freely controlled.

In the present invention, with respect to the phenolic resin adhesive agent, a phenolic resin whose resin components are adjusted to contain 10 to 40% by weight of a monomer having a molecular weight of 90 to 200 and 60 to 90% by weight (total of two components: 100% by weight) of a polymer having a molecular weight of 200 to 2,000, with an average molecular weight (weight average molecular weight: Mw) being set in a range of 400 to 700, is preferably used. The monomer which has a small molecular size, exerts high permeability into the kenaf fiber 1 so that as shown in FIG. 4(*b*), the monomer m is allowed to mainly permeate into the kenaf fiber 1, while the polymer, which has a great molecular size, has poor permeability into the kenaf fiber 1 so that as shown in FIG. 4(*c*) the polymer p is allowed to mainly adhere to the surface of the kenaf fiber 1. Therefore, when the phenolic resin adhesive agent is cured in a molding process, the monomer is cured inside the kenaf fiber 1 so that it suppresses absorption of moisture into the kenaf fiber 1 even when the fiber board absorbs water; thus, it is possible to suppress swelling and deformation of the kenaf fiber 1, and consequently to improve the dimension stability of the fiber board. Moreover, the polymer is cured on the surface of the kenaf fiber 1 so that the kenaf fibers 1 are mutually bonded to and combined with one another firmly; thus, it becomes possible to increase the peel strength of the fiber board. In this manner, it becomes possible to provide a fiber board that is superior in dimension stability and also has high peel strength.

In the case of a content of the monomer of less than 10% by weight in the phenolic resin with a content of the polymer exceeding 90% by weight, the amount of resin components that permeate into the kenaf fiber 1 becomes smaller, failing to provide sufficient dimension stability. In contrast, in the case of a content of the monomer exceeding 40% by weight, with a content of the polymer being less than 60% by weight, the amount of resin components adhering to the surface of the kenaf fiber 1 becomes smaller, the peel strength of the fiber board becomes insufficient. Moreover, when the average molecular weight of the phenolic resin is less than 400, the amount of resin components adhering to the surface of the kenaf fiber 1 becomes smaller, resulting in insufficient peel strength in the fiber board, and when the average molecular weight of the phenolic resin exceeds 700, the amount of resin components that permeate into the kenaf fiber 1 becomes smaller, failing to provide sufficient dimension stability. Therefore, in order to satisfy both of the characteristics of dimension stability and peel strength, a phenolic resin which has a monomer and a polymer whose contents and average molecular weights are set within the above-mentioned ranges needs to be used.

In the case where the fiber board A produced by way of the aforementioned processes is used as a floor surface material and the like, it is necessary to stick the facing material 28, such as a sliced veneer, a decorative sheet and the like on the surface of the fiber board A by means of the adhesive agent 29. However, since the fiber board A is a porous board having gaps, the adhesive agent 29 applied on the surface of the fiber board A penetrates into the gaps and is absorbed therein to bring about a decrease of a bonding strength of the facing material 28 caused by the adhesive agent 29, and the facing material 28 is apt to release. As the result, it is apprehended that a problem concerning a durability against a reciprocating load of a caster and the like will be brought about.

Figure 6A:
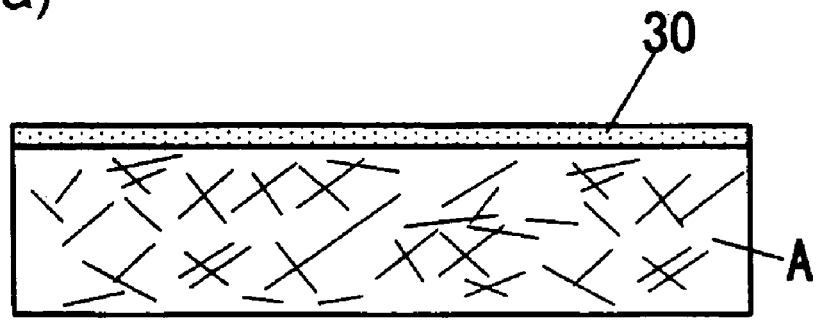
FIG. 6(*a*) is a diagrammatic sectional view of one embodiment of a fiber board for carrying out the present invention.
Figure 6B:
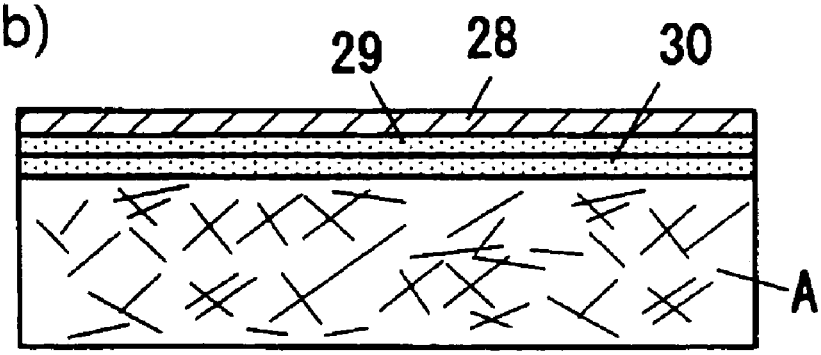

Accordingly, the coating process of a second adhesive agent 30, in which the second adhesive agent whose impregnability is lower than that of the aforementioned thermosetting adhesive agent impregnated in the fiber mat 14 is coated on the surface of the fiber board obtained in the molding process, is added after the molding process. The second adhesive agent 30 having a low impregnability is hard to penetrate into the gaps of the fiber board A, and there is no possibility that the second adhesive agent 30 fills up the gaps of the surface layer of the fiber board A to form a smooth primary coat on the surface of the fiber board A as shown in FIG. 6(*a*). Therefore, as shown in FIG. 6(*b*), by applying the adhesive agent 29 on the smooth primary coat formed of the second adhesive agent 30 and adhering the facing material 28 on the layer of the adhesive agent 29, a penetration of the adhesive agent 29 into the fiber board A is prevented to stick the facing material 28 over the surface of the fiber board A with a high bonding strength and to achieve the smooth surface, and it is possible to increase a durability against the caster and the like.

Although the second adhesive agent 30 is not particularly restricted provided that it has higher viscosity and lower impregnability than those of the aforementioned thermosetting adhesive agent impregnated in the fiber mat 14, SBR latex and the like can be employed. And although the viscosity of the second adhesive agent 30 is not particularly restricted, a range of about 1–40 Pa·s is preferable. In order to increase the viscosity of the second adhesive agent 30 to such a range of viscosity, a powder may be mixed with the second adhesive agent 30. A preferable powder is that having a particle size of 5 mm or less, and the powder may be a fine powder, such as wheat flour, shavings of the edge surface of the fiber board A and the like.

Figure 7A:
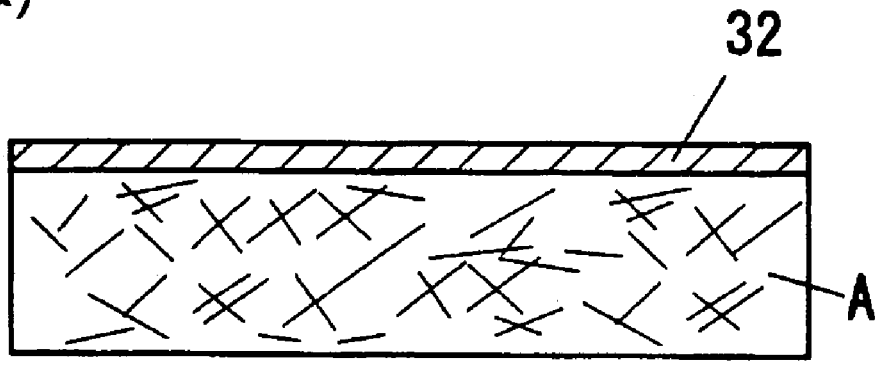
FIG. 7(*a*) is a diagrammatic sectional view of one embodiment of a fiber board for carrying out the present invention.
Figure 7B:
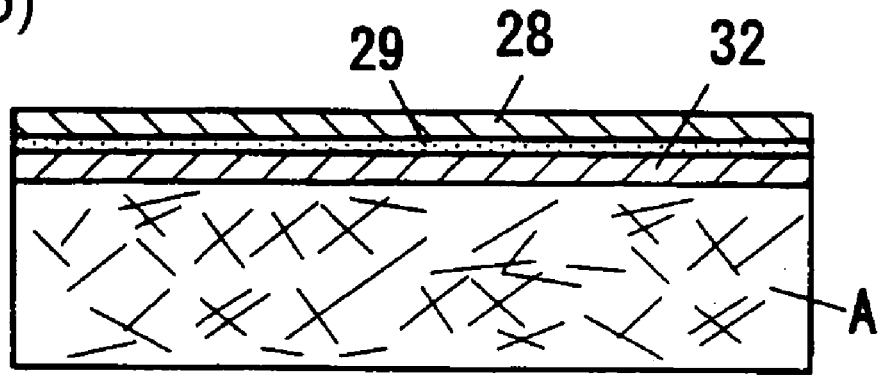

As shown in FIG. 7(*a*), the fine fiber sheet 32 may be adhered in a laminated sate on the surface of the fiber board A before the facing material 28 is stuck on said surface with the adhesive agent 29 as mentioned above. The adhesion of the fine fiber sheet 32 can be carried out at the same time as the molding of the fiber board A by laminating the fine fiber sheet 32 on the surface of the fiber mat 14 and then heating said laminate under pressure when the fiber mat 14 is molded under heat and pressure in the molding process. After the fiber board A has been molded, the fine fiber sheet 32 may be stuck on the surface of the fiber board A. As shown in FIG. 7(*b*), the facing material 28 can be stuck on the surface of the fiber board A by adhering the facing material 28 on the fine fiber sheet 32 with the adhesive agent 29. An absorption of unevenness of the surface of the fiber board A as well as a smoothening of the surface of the facing material 28 can be achieved by means of the fine fiber sheet 32 formed of fine fibers, and it is possible to increase the durability against the reciprocating load of the caster and the like.

The fine fiber sheet 32 is formed of the fine fibers having a smaller fiber diameter than that of the aforementioned kenaf fibers 1, and a preferable fiber diameter of the fine fibers is a range of 5–100 μm. When the fiber diameter of the fine fibers exceeds 100 μm, a smoothness of the fine fiber sheet 32 is deteriorated, and it is apprehended that the surface of the facing material 28 stuck on the fine fiber sheet 32 becomes uneven. Although the smaller the fiber diameter of the fine fibers is, the more preferable the fine fibers are, it is difficult to prepare fine fibers whose diameter is less than 5 μm, and it is hard to obtain them. And although the fine fibers are not particularly restricted, wood pulp fibers, for example, can be used, and the paper and sheet formed of the wood pulp fibers can be employed as the fine fiber sheet 32. The fine fiber sheet 32 formed of the wood pulp fibers is preferable from the viewpoints of easiness of availability, relative excellence of adhesiveness owing to similar constituents to those of plant fibers such as kenaf fibers and the like, and so forth. Of course, the fine fiber sheet 32 is not restricted to these paper and sheet formed of the wood pulp fibers, and polyester nonwoven fabric and the like may be employed. Preferable fine fiber sheet 32 has a thickness of a range of 5–200 μm. If the thickness of the fine fiber sheet 32 is less than 5 μm, a strength of the fine fiber sheet 32 becomes weak, and it is feared that the fine fiber sheet 32 will be broken when it is stuck. If the thickness of the fine fiber sheet 32 exceed 200 μm, it is feared that a breaking will occur within the fine fiber sheet 32 against the reciprocating load of the caster and the like. In addition, a preferable fine fiber sheet 32 has a weight per unit area of 10–100 g/m$^2$. If the weight per unit area of the fine fiber sheet 32 is less than 10 g/m$^2$, it does not afford a sufficient surface smoothness since an absolute amount of the fibers constituting the fine fiber sheet 32 becomes less. On the other hand, the weight per unit area of the fine fiber sheet 32 exceeds 100 g/m$^2$, there is a possibility that a portion wherein the fine fibers constituting the fine fiber sheet 32 are not sufficiently interlocked each other will be formed, and it is feared that the fine fiber sheet 32 will be broken from said portion.

In this embodiment, it is preferable to make holes 33 penetrating through the inside and outside of the fine fiber sheet 32. These holes 33 can be made by adding the boring process of holes after the molding process. The holes 33 may be formed as dotted holes 33*a* shown in FIG. 8(*a*) or as grooved holes (slit holes) 33*b* shown in FIG. 8(*b*), and it is preferable to arrange the holes over the whole surface of the fine fiber sheet 32.

By arranging the holes 33 penetrating the fine fiber sheet 32, the adhesive agent 29 can be impregnated to an inner portion of the fiber mat 14 through these holes 33 when the facing material is adhered on the fine fiber sheet 32 with the adhesive agent 29 as shown in FIG. 7(*b*), and a bonding strength of the facing material 28 to the fiber board A can be increased, and it is possible to obtain a high durability against the reciprocating load of the caster and the like.

Figure 8A:
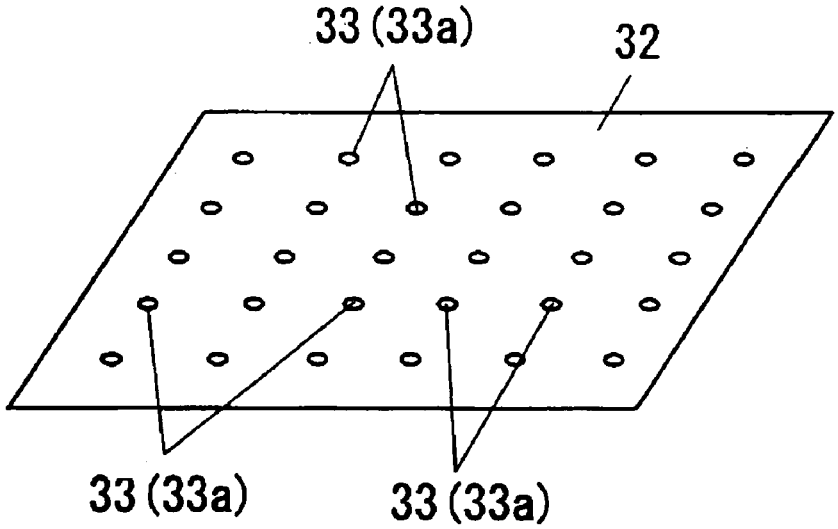
FIG. 8(*a*) is a perspective view of fine fiber sheet.
Figure 8B:
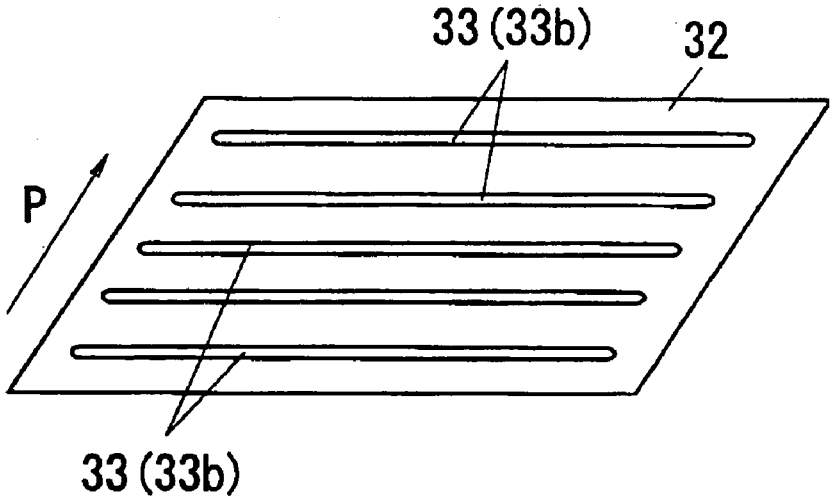
Figure 8C:
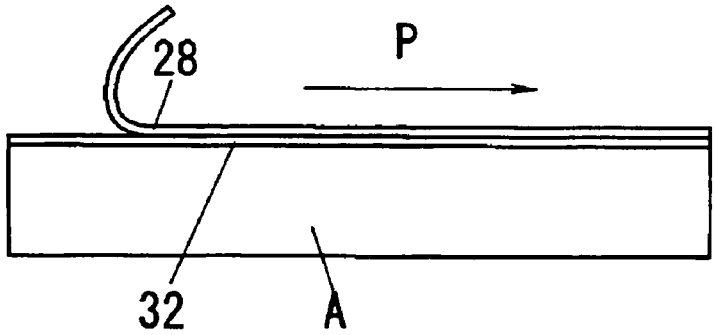

In the case where the grooved holes 33*b* are made as shown in FIG. 8(*b*), it is preferable to make the grooved holes 33*b* in the direction which is rectangular to the fiber direction P of the sliced veneer when the sliced veneer made of wood is employed as the facing material. In such an embodiment, when the facing material 28 is peeled off in the fiber direction P as shown in FIG. 8(*c*), the facing material 28 is broken and cut off at a portion of the grooved holes 33(*b*) in such a way that the peeling of the facing material 28 does not further proceed, and it is possible to more effectively prevent the release of the facing material 28.

EXAMPLE

The following description will discuss the present invention in detail by means of examples. Here, the measurements of the molecular weight were carried out by using a GPC measuring device "HLC 802A" made by Tosoh Corporation through a gel permeation chromatograph (GPC) method. In this case, an adhesive agent solution to be used in the molecular-weight measurements was dissolved in a THF solution, and then filtered through a filter to be used for the analysis. The molecular weight calculations were carried out based upon polyethylene conversion, and the weight-average value was used as the molecular weight of the adhesive agent.

Example 1

Long fiber bundles (width: 1 to 2 cm, length: 2 to 4 cm), obtained from bast portions of kenaf stems were mechanically defibrated so that kenaf fibers having an average length of 25 mm and an average diameter of 100 μm were obtained. Next, these kenaf fibers were laminated and subjected to a needle punching process to obtain a fiber mat. Next, this fiber mat was immersed in a phenolic resin adhesive agent, and then squeezed through squeezing rollers so that the content of the phenol resin adhesive agent was adjusted to 25% by mass. In this case, the resol type phenolic resin adhesive agent having a weight-average molecular weight of 584 (proportion of resin component: 50 percent by weight) which comprises a monomer having a molecular weight of 90–190 and a polymer having a molecular weight of 200–2,000 in a weight ratio of 30:70 was used as the phenolic resin adhesive agent after it was mixed with water in such a way that a proportion of resin solid component is adjusted to 22.2 percent by weight. The fiber mat was impregnated with the phenolic resin adhesive agent, and then the fiber mat was passed through the squeezing roller to adjust the add-on of the thermosetting resin impregnated in the fiber mat to 120 percent by weight relative to a weight of the fiber mat.

The fiber mat containing the phenolic resin adhesive agent was dried at 80° C. so that the moisture content thereof was set to 10% by mass. Then, this fiber mat was molded under heat and pressure under conditions of 170° C., 3 MPa and 4 minutes to obtain a kenaf fiber board having a thickness of 4 mm. A density of the kenaf fiber board was 600 kg/m$^3$, and the add-on of resin in said board was 25 percent by weight.

Example 2

The similar processes to example 1 were carried out except that the density of the kenaf fiber board was set to 750 kg/m$^3$.

Example 3

The similar processes to example 1 were carried out except that the density of the kenaf fiber board was set to 800 kg/m$^3$.

Example 4

The similar processes to example 1 were carried out except that the density of the kenaf fiber board was set to 850 kg/m$^3$.

Example 5

The similar processes to example 1 were carried out except that the density of the kenaf fiber board was set to 900 kg/m$^3$.

Comparative Example 1

The similar processes to example 1 were carried out except that the density of the kenaf fiber board was set to 500 kg/m$^3$.

Comparative Example 2

The similar processes to example 1 were carried out except that the density of the kenaf fiber board was set to 1,000 kg/m$^3$.

Comparative Example 3

A commercial plywood (lauan plywood) having a thickness of 4 mm and a density of 550 kg/m$^3$ was used.

By using the above-mentioned kenaf fiber boards of examples 1 to 5 and comparative examples 1 and 2 as well as plywood of comparative example 3 as samples, the moisture permeation resistance and bending strength were measured. Table 1 shows the results.

The measurements of the moisture permeation resistance were carried out based upon a cup method shown in JIS A 1324 (moisture permeability measuring method for construction materials). In other words, calcium chloride was put into a moisture permeable cup having a diameter of 30 cm, and this cup was sealed with each sample so that the sample was attached thereto. Next, the cups to which the samples had been attached were put into a thermo-hygrostat that was set to a temperature of 23° C. with relative humidity of 50%, and the cups were taken out thereof with predetermined time intervals so that a mass increase of the cup was measured to find the moisture permeation amount of the sample. Further, the moisture permeation resistance was calculated from the following equation.

$$Zp=(P_1-P_2)\times A/G$$

In this equation, Zp: moisture permeation resistance [(m²·s·Pa)/ng]{(m²·h·mmHg)/g}, G: moisture permeation amount (ng/s){g/h}, A: moisture permeation area (0.0625 m²), $P_1$: water vapor pressure of air in the thermo-hygrostat (Pa){mmHg}, $P_2$: water vapor pressure of air inside the moisture permeable cup (0Pa){0mmHg}.

The bending strength was measured through bending strength tests based upon JIS A 5905 (fiber board).

TABLE 1

| | Kinds of boards | Board density kg/m³ | Moisture permeation resistance m² · h · mmHg/g | (m² · s · Pa/ng) | Bending strength MPa |
|---|---|---|---|---|---|
| Example 1 | Kenaf fiber board | 600 | 0.42 | (882) | 48 |
| Example 2 | 4 mm in thickness | 750 | 0.72 | (1512) | 65 |
| Example 3 | | 800 | 0.99 | (2079) | 88 |
| Example 4 | | 850 | 1.34 | (2814) | 110 |
| Example 5 | | 900 | 2.56 | (5376) | 120 |
| Comparative Example 1 | Kenaf fiber board 4 mm in thickness | 500 | 0.23 | (483) | 20 |
| Comparative Example 2 | | 1000 | 4.89 | (10269) | 150 |
| Comparative Example 3 | Plywood 4 mm in thickness | 550 | 2.79 | (5859) | 40 |

As indicated by Table 1, with respect to examples 1 to 5, the moisture permeation resistance is 5,376 (m²·s·Pa)/ng at most, and the bending strength is 48 MPa at the minimum; thus, it is confirmed that any of the kenaf fiber boards of examples 1 to 5 have high moisture permeability and strength.

It is confirmed that, even when predetermined kenaf fibers are used, the density of lower than 600 kg/m³ causes a serious reduction in the bending strength as indicated by the kenaf fiber board of comparative example 1, while the density exceeding 900 kg/m³ causes a serious increase in the moisture permeation resistance as indicated by the kenaf fiber board of comparative example 2, failing to provide a well-balanced state between the moisture permeation resistance and the strength. Moreover, in the case of commercial plywood of comparative example 3, it is confirmed that it is not possible to obtain preferable moisture permeation resistance and sufficient strength.

Example 6

Kenaf fibers having an average fiber length of 25 mm and an average fiber diameter of 100 μm were allowed to aggregate to prepare a fiber mat having a mat face weight of 0.94 g/cm². The moisture content of this fiber mat was measured and found to be 25% by weight.

In the adhesive agent supplying process, with respect to the phenolic resin adhesive agent, a resol-type phenolic resin adhesive agent (resin component ratio: 50% by weight), which contained a monomer having a weight average molecular weight of 498 with a range of molecular weight of 90 to 190 and a polymer having a range of molecular weight of 200 to 2,000 at a weight ratio of 40:60, was used, and this fiber mat was immersed in the phenolic resin adhesive agent for 10 seconds, and this was then squeezed through squeezing rollers so that the phenolic resin adhesive agent was allowed to adhere to the fiber mat with a content of the phenolic resin component being set to 25% by weight.

In the adhesive agent drying process, a dry air flow at 50° C. was directed to the fiber mat coated with the adhesive agent so that the moisture content in the fiber mat was set to 10% by weight, to dry the fiber mat.

In the molding process, three layers of the above-mentioned dried fiber mats were laminated, and molded under heat and pressure under conditions of a molding temperature of 170° C., a molding pressure of 3 MPa and a period of time of 3.5 minutes to obtain a kenaf fiber board having a thickness of 4 mm and a board density of 750 kg/m³.

Example 7

The same processes as example 6 were carried out except that, in the adhesive agent supplying process, with respect to the phenolic resin adhesive agent, a resol-type phenolic resin adhesive agent (resin component: 50% by weight), which contained a monomer having a weight average molecular weight of 560 with a range of molecular weight of 90 to 190 and a polymer having a range of molecular weight of 200 to 2,000 at a weight ratio of 30:70, was used; thus, a kenaf fiber board was prepared.

Example 8

The same processes as example 6 were carried out except that, in the adhesive agent supplying process, with respect to the phenolic resin adhesive agent, a resol-type phenolic resin adhesive agent (resin component: 52% by weight), which contained a monomer having a weight average molecular weight of 640 with a range of molecular weight of 90 to 190 and a polymer having a range of molecular weight of 200 to 2,000 at a weight ratio of 20:80, was used; thus, a kenaf fiber board was prepared.

Example 9

A fiber mat was first dried in the fiber-mat drying process to have a moisture content of 13% by weight. The same processes as example 8 were carried out except that the fiber mat thus dried was used to prepare a kenaf fiber board.

Example 10

The same processes as example 6 were carried out except that, in the adhesive agent supplying process, with respect to the phenolic resin adhesive agent, a resol-type phenolic resin adhesive agent (resin component: 47% by weight), which contained 100% of a polymer having a weight average molecular weight of 360 with a range of molecular weight of 200 to 650, was used; thus, a kenaf fiber board was prepared.

Example 11

The same processes as example 6 were carried out except that, in the adhesive agent supplying process, with respect to the phenolic resin adhesive agent, a resol-type phenolic resin adhesive agent (resin component: 52% by weight), which contained 100% of a polymer having a weight average molecular weight of 605 with a range of molecular weight of 200 to 1,000, was used; thus, a kenaf fiber board was prepared.

Example 12

The same processes as example 6 were carried out except that, in the adhesive agent supplying process, with respect to the phenolic resin adhesive agent, a resol-type phenolic resin adhesive agent (resin component: 53% by weight), which contained 100% of a polymer having a weight average molecular weight of 1,010 with a range of molecular weight of 200 to 2,000, was used; thus, a kenaf fiber board was prepared.

Example 13

The same processes as example 6 were carried out except that, in the adhesive agent supplying process, with respect to the phenolic resin adhesive agent, a resol-type phenolic resin adhesive agent (resin component: 47% by weight), which contained a monomer having a weight average molecular weight of 450 with a range of molecular weight of 90 to 190 and a polymer having a range of molecular weight of 200 to 1,000 at a weight ratio of 60:40, was used; thus, a kenaf fiber board was prepared.

Example 14

The same processes as example 6 were carried out except that, in the adhesive agent supplying process, with respect to the phenolic resin adhesive agent, a resol-type phenolic resin adhesive agent (resin component: 52% by weight), which contained a monomer having a weight average molecular weight of 690 with a range of molecular weight of 90 to 190 and a polymer having a range of molecular weight of 200 to 2,000 at a weight ratio of 3:97, was used; thus, a kenaf fiber board was prepared.

By using the above-mentioned kenaf fiber boards formed in examples 6 to 14, tests were carried out with respect to the expansion coefficient in water-absorption thickness and peel strength in accordance with methods standardized in JIS A 5905 (fiber board). Table 2 shows the results.

TABLE 2

| | | | | | Polymer components | | Board physical properties | |
|---|---|---|---|---|---|---|---|---|
| | Mat moisture content prior to resin impregnation | Average molecular weight of adhesive agent | Rate of monomer and polymer | Monomer component Molecular weight range | having polymerization degree of 2 or more Molecular weight range | Total resin weight ratio | Expansion coefficient in water-absorption thickness (%) | Peel strength (Mpa) |
| Example 6 | 25% | 498 | 40:60 | 90 to 190 | 200 to 2000 | 25.0% | 6.7 | 2.2 |
| Example 7 | | 560 | 30:70 | | | | 6.9 | 2.5 |
| Example 8 | | 640 | 20:80 | | | | 7.3 | 2.7 |
| Example 9 | 13% | 640 | 20:80 | | | | 6.6 | 2.7 |
| Example 10 | 25% | 360 | 0:100 | — | 200 to 650 | 25.0% | 18.5 | 0.4 |
| Example 11 | | 605 | 0:100 | — | 200 to 1000 | | 15.3 | 1.8 |
| Example 12 | | 1010 | 0:100 | — | 200 to 2000 | | 22.5 | 2.9 |
| Example 13 | | 450 | 60:40 | 90 to 190 | 200 to 1000 | | 12.8 | 1.2 |
| Example 14 | | 690 | 3:97 | | 200 to 2000 | | 12.9 | 1.6 |

As indicated by Table 2, it is confirmed that any of the fiber boards shown in examples 6 to 9 have a small expansion coefficient in water-absorption thickness, are superior in dimension stability and also have high peel strength.

Example 15

The kenaf fibers having an average fiber length of 30 mm and an average fiber diameter of 150 μm obtained by defibrating the kenaf were laminated, and then the fiber mat was obtained by needle-punching said laminate. The fiber mat was immersed in the phenolic resin adhesive agent which is the same adhesive agent as that used in Example 1, and then the add-on of the phenolic resin adhesive agent was adjusted to 25 percent by mass by wringing the fiber mat through the squeezing roller. Then the fiber mat impregnated with the phenolic resin adhesive agent was dried at 80° C. in such a way that the moisture content of the fiber mat was about 10 percent by mass.

Polyester nonwoven fabric (average fiber diameter of fine fibers: 120 μm, thickness: 220 μm, face weight: 140 g/m$^2$, elastic coefficient: 46 MPa) was used as a fine fiber sheet. The fine fiber sheet was laminated on the fiber mat, and then the fiber board on which the fine fiber sheet was stuck (density: 750 kg/m$^3$, thickness: 11.7 mm) was produced by molding said laminate at 170° C. under a pressure of 3 MPa for 10 minutes.

A sliced veneer having a thickness of 0.3 mm was used as a facing material. One side of the facing material was coated with the phenolic resin adhesive agent, and the facing material was laminated on the fine fiber sheet in a state that the coated side of the facing material was contact with the fine fiber sheet, and then the floor 5 material was obtained by heating said laminate at 120° C. under pressure of 0.8 MPa for one minute to stick the facing material on the fine fiber sheet through adhesive agent layer having a thickness of 20 μm.

Example 16

The floor material was produced by the same manner as in the case of Example 15 except that the pulp sheet (average fiber diameter of fine fibers: 120 μm, thickness: 230 μm, face weight: 140 g/m$^2$, elastic coefficient: 42 MPa) was used as a fine fiber sheet.

Equivalent Young's modulus in flexure, resistance to castering times and surface hardness of the floor materials obtained in Examples 15 and 16 were measured, and a heat and cold B test on these floor materials was made. The equivalent Young's modulus in flexure is the Young's modulus in flexure on the assumption that the whole of the floor material has a homogeneous structure, and the measurement thereof was carried out according to the conventional flexural test (JIS A5905 etc). The resistance to castering times was measured as necessary times to release the facing material in a test wherein the caster having a diameter of 50 mm was placed on he surface of the floor material and was reciprocated under a load of 250 N at a speed of 20 reciprocations/min. And the surface hardness was measured as an amount of compressive strain by hard ball, said amount being a denting amount when a load of 300 N was applied to the surface of the floor material by means of the hard ball having a diameter of 10 mm. In this case, the less the denting amount is, the more excellent the surface hardness of the floor material is. Furthermore, the heat and cold B test was carried out according to JAS (special plywood). The results are shown in Table 3.

TABLE 3

Results of the evaluations

| | Equivalent Young's modulus in flexure (GPa) | Resistance to castering times (times) | Surface hardness (compressive strain by hard ball); denting amount (mm) | Heat and cold B test; rate of change in length (%) |
|---|---|---|---|---|
| Example 15 | 9.6 | 22000 | 0.11 | 0.07 |
| Example 16 | 9.6 | 24000 | 0.10 | 0.07 |

Example 17

The surface of the fiber board which is the same board as that used in Example 15 was coated with SBR latex having a viscosity of 3 Pa·s (the second adhesive agent) (coating weight: 320 g/m$^2$), and the sliced veneer having a thickness of 0.3 mm (facing material) which is the same material as that used in Example 15 was stuck on the fiber board surface coated with said latex under the same condition as that employed in Example 15. The viscosity of the phenolic resin adhesive agent impregnated in the fiber board was 0.01 Pa·s.

Example 18

The same procedures as those employed in Example 17 were carried out except that a mixture having a viscosity of 30 Pa·s prepared by mixing 23 percent by weight of wheat flour with SBR latex having a viscosity of 3 Pa·s was used as the second adhesive agent, and the coating weight of the mixture was 75 g/m$^2$.

Example 19

The same procedures as those employed in Example 17 were carried out except that a mixture having a viscosity of 16 Pa·s prepared by mixing 23 percent by weight of ground product of the fiber board (average fiber length: 0.25 mm) with SBR latex having a viscosity of 3 Pa·s was used as the second adhesive agent, and the coating weight of the mixture was 87 g/m$^2$.

The resistance to castering times on the floor materials obtained in Examples 17–19 was measured by the same manner as that used in Example 16. There was nothing abnormal about the floor material obtained in Example 17 after 13000 times of the reciprocating movement of caster. In this case, a test concerning more than 13,000 times of the reciprocating movement of caster was not carried out. There was nothing abnormal about the floor materials obtained in Examples 18 and 19 after 26,000 times of the reciprocating movement of caster. In these cases, a test concerning more than 26,000 times of the reciprocating movement of caster was not carried out.

INDUSTRIAL APPLICABILITY

Since the fiber board according to the present invention has a high permeability as well as a sufficiently high strength, said fiber board can be utilized not only as a wall material which forms the walls of a house and the like, but also as building materials, such as a floor material, a ceiling material, a substrate material and the like that require the permeability and strength as in the case of the wall material.

The invention claimed is:

1. A method of producing a fiber board comprising:

(a) a separating process of a bast portion wherein the bast portion of a kenaf is separated from a stem core portion, (b) a fiberizing process wherein kenaf fibers are obtained from the bast portion of the kenaf by defibrating the bast portion of the kenaf, (c) a preparing process of a mat wherein the kenaf fibers obtained by said defibrating treatment are aggregated to form a fiber mat comprising kenaf fibers having an average length of 10–200 mm and an average diameter of 10–300 μm, (d) a supplying process of an adhesive agent wherein the fiber mat is impregnated with a thermosetting adhesive agent by supplying the thermosetting adhesive agent into the fiber mat, wherein the thermosetting adhesive agent is a phenolic resin having an average molecular weight of 400–700, said phenolic resin comprising 10–40 percent by weight of monomer and 60–90 percent by weight of polymer having an average molecular weight of 200–2,000, (e) a drying process of the adhesive agent wherein the fiber mat impregnated with the thermosetting adhesive agent is dried in an atmosphere of 120° C. or less while an inner portion of the fiber mat is sucked from one side thereof, and (f) a molding process wherein the fiber mat obtained in the drying process of the adhesive agent is molded by heating said fiber mat under pressure to form a fiber board having a density of 600–900 kg/m$^3$.

2. The method of producing a fiber board according to claim 1, further comprising an adjusting process of an add-on, in which the fiber mat impregnated with the thermosetting adhesive agent is pressed in such a way that an amount of the thermosetting adhesive agent impregnated in the fiber mat is 130% or less relative to a weight of the fiber mat, wherein said adjusting process is performed before the drying process of the adhesive agent.

3. The method of producing a fiber mat according to claim 2, wherein the method of pressing the fiber mat in the adjusting process of an add-on is a method wherein the fiber mat impregnated with the thermosetting adhesive agent is passed between a pair of rollers.

4. The method of producing a fiber board according to claim 1, further comprising a drying process of the fiber mat, in which a moisture content of the fiber mat is adjusted to 25 percent by weight or less, wherein said further drying process is performed before the supplying process of the adhesive agent.

5. The method of producing a fiber board according to claim 1, wherein in that when the fiber mat impregnated with the thermosetting adhesive agent is dried in the drying process of the adhesive agent, said fiber mat is dried while a surface thereof is contacted with an air stream whose temperature is 120° C. or less.

6. The method of producing a fiber board according to claim 1, further comprising an adjusting process of a moisture content in the bast portion, in which a moisture content of the bast portion of kenaf separated from the stem core portion is adjusted to 10–40 percent by weight, wherein said further adjusting process is performed before the fiberizing process.

7. The method of producing a fiber board according to claim 1, further comprising a coating process of a second adhesive agent, in which the second adhesive agent whose impregnability is lower than that of the thermosetting adhesive agent impregnated in the fiber mat is applied on a surface of the fiber board obtained in the molding process, wherein said further coating process is performed after the molding process.

8. The method of producing a fiber mat according to claim 1, wherein when the fiber mat is heated under pressure in the molding process, a fine fiber sheet comprising fine fibers whose diameter is smaller than that of the kenaf fibers constituting the fiber mat is laminated on the surface of the fiber mat, and then said laminate is heated under pressure.

9. The method of producing a fiber board according to claim 8, wherein after the laminate of the fiber mat and fine fiber sheet is heated under pressure, holes which penetrate through the fine fiber sheet are arranged on said sheet.

* * * * *